United States Patent [19]

Maya

[11] 4,296,350

[45] Oct. 20, 1981

[54] GASEOUS FLUORESCENT DISCHARGE LAMP

[75] Inventor: Jakob Maya, Boston, Mass.

[73] Assignee: GTE Products Corporation, Stamford, Conn.

[21] Appl. No.: 106,297

[22] Filed: Dec. 21, 1979

[51] Int. Cl.[3] ..... N01J 1/02

[52] U.S. Cl. ..... 313/26; 313/185; 313/220; 313/483

[58] Field of Search ..... 313/26, 25, 220, 185, 313/483

[56] References Cited

U.S. PATENT DOCUMENTS

| | | | |
|---|---|---|---|
| 2,114,175 | 4/1938 | Cartun | 313/26 X |
| 3,085,171 | 4/1963 | Smialek | 313/25 |
| 3,947,719 | 3/1976 | Ott | 313/220 X |

*Primary Examiner*—Stanley T. Krawczewicz
*Attorney, Agent, or Firm*—James Theodosopoulos

[57] ABSTRACT

An arc discharge lamp comprises a source of UV emission and a chamber external thereto. The chamber contains gaseous molecules which absorb the UV emission and are raised to a highly excited state, from which they relax to the ground state through an intermediate energy state. The transition from either the highly excited state to the intermediate state, or from the intermediate state to the ground state, is accompanied by emission of visible light.

5 Claims, 1 Drawing Figure

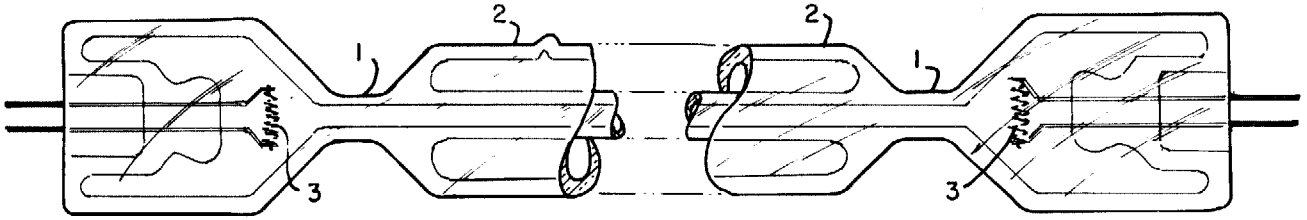
1
2
2
1
3
3

GASEOUS FLUORESCENT DISCHARGE LAMP

THE INVENTION

This invention is concerned with lamps and especially with lamps that convert ultraviolet (UV) radiation into visible radiation. In fluorescent lamps, the UV radiation from a low pressure mercury arc, principally at about 254 nanometers (nm), is converted into visible radiation by a phosphor coating on the inner wall of the lamp envelope. In high pressure mercury vapor lamps, a significant portion of the energy radiated by the mercury arc is in the UV region and some of this is converted to visible light by a phosphor coating on an outer bulb surrounding the arc tube. In these types of lamps the phosphor is a solid. In my invention a gas is used to convert UV radiation into visible light.

The gas produces light by a non-resonant fluorescent process. In this process, a UV photon is absorbed by a gas molecule in the ground state, which is raised thereby to a highly excited state. The excited molecule relaxes back to the ground state through an intermediate state, which is at a lower energy level than the highly excited state but higher than the ground state. The intermediate state is optically coupled to either the highly excited state or the ground state, so that the optically coupled transition results in emission of a visible photon, that is to say, in radiation of visible light. Generally, the visible radiation results when the excited molecule relaxes from the intermediate state to the ground state, although for some metal molecules the visible radiation results during the transition from the highly excited state to the intermediate state. The molecule in the highly excited state relaxes to the intermediate state in a period of about $10^{-12}$ to $10^{-14}$ seconds. The whole transition process from the highly excited state to the ground state lasts about $10^{-8}$ to $10^{-6}$ seconds.

The single FIGURE in the drawing is a broken view of a lamp in accordance with this invention.

In a preferred embodiment, a lamp in accordance with this invention comprises an arc tube 1 surrounded by a glass chamber 2. Arc tube 1 is a UV source and chamber 2 contains a substance that emits visible radiation during lamp operation.

In one example, arc tube 1 was made of fused quartz and had an electrode 3 at each end. The distance between electrodes 3 was 52 cm and the overall length was 64 cm. The central portion of arc tube 1 was tubular, being 1 cm in diameter for a length of about 30 cm. Arc tube 1 contained 40 mg of mercury plus krypton gas at 1.5 torr. Chamber 2 was also made of quartz and was 28 cm long by 2 cm in diameter. Chamber 2 was coaxial with arc tube 1 and was hermetically sealed thereto at its ends. Chamber 2 contained the light emitting substance.

Arc tube 1 was operated at current densities from about 2 to 12 amperes per square centimeter; arc drops typically ranged from 50 to 80 volts rms. Arc tube 1 was operated at wattages up to about 600 to 700 watts. The operation of arc tube 1 was such as to be efficient in the production of UV radiation. THe UV discharge in arc tube 1 was operated at a wattage sufficient to obtain a wall temperature of chamber 2 of at least about 200° C.

The light emitting substance in chamber 2, although generally added as a solid, must be present in the vapor form during lamp operation. It is desirable that it have a vapor pressure of at least about 1 torr at about 200° or 300° C.

An example of an organic compound that operated satisfactorily as the light emitting substance is (2, 2' -p-phenylenebis [5 phenyloxazole]), known as POPOP, of which 40 mg were placed in chamber 2. Upon absorption of UV peaking at about 320 nm, the POPOP molecules were raised to the highly excited state of 3.87 electron volts, from which they relaxed non-radiatively to an intermediate energy state of 2.63 electron volts, and then radiatively to the ground state. The latter transition was accompanied by emission of violet visible light. Another organic substance that could be used is xanthene dye N92, the highly excited state of which is 4.96 electron volts, corresponding to absorption of UV peaking at about 250 nm. The intermediate state is 2.63 electron volts and the transition therefrom to the ground state is accompanied by radiation of bluish violet visible light.

An example of a complex metal halide substance that could be used is aluminum-terbium chloride ($AlCl_3$-$TbCl_3$), the highly excited state of which is 4.8 electron volts, corresponding to absorption of UV peaking at about 258 nm. The intermediate state is 2.25 electron volts and the transition therefrom to the ground state is accompanied by radiation of green light.

An example of a metallic substance that could be used is mercury-cadmium, which would be present in the vapor form as mercury-cadmium (HgCd) molecules. The highly excited state thereof would be 4.66 electron volts, corresponding to absorption of UV peaking at about 266 nm. The transition therefrom to the intermediate state of 2.63 electron volts would be accompanied by radiation of bluish light.

I claim:

1. An arc discharge device comprising a source of UV emission and a chamber external thereto containing a substance which, in vapor form, comprises gaseous molecules which absorb said UV emission and are raised to a highly excited state, from which the excited molecules relax to a lower intermediate energy state and then to a ground state, one of the two latter states being optically coupled to the immediate higher energy state so that the transition of said molecules from either the highly excited state to the intermediate state or from the intermediate state to the ground state results in the emission of visible radiation.

2. The device of claim 1 wherein said chamber is heated by said source of UV emission, and the vapor pressure of said substance is raised as a result thereof.

3. The device of claim 1 wherein said source of UV emission is an arc tube, and said chamber is an outer tube surrounding said arc tube.

4. The device of claim 1 wherein the UV emission of said source matches the absorption band of said substance.

5. The device of claim 1 wherein said substance has a vapor pressure of at least about 1 torr at a temperature of about 200° to 300° C.

* * * * *